US008176650B2

(12) United States Patent
Hada et al.

(10) Patent No.: US 8,176,650 B2
(45) Date of Patent: May 15, 2012

(54) METHOD FOR WARMING UP OR COOLING DOWN A THROUGH-AIR DRYER

(75) Inventors: Frank S. Hada, Appleton, WI (US); Robert J. Seymour, Appleton, WI (US); Marek Parszewski, New London, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1249 days.

(21) Appl. No.: 11/302,744

(22) Filed: Dec. 13, 2005

(65) Prior Publication Data

US 2007/0130793 A1 Jun. 14, 2007

(51) Int. Cl.
*F26B 25/00* (2006.01)

(52) U.S. Cl. ..... 34/114; 34/117; 34/124; 34/126; 162/55; 162/63; 53/551; 53/552

(58) Field of Classification Search ..... 34/446, 34/454, 90, 100, 114, 117, 124, 125, 126; 162/55, 63; 53/551, 552
See application file for complete search history.

(56) References Cited

U.S. PATENT DOCUMENTS

| | | | | |
|---|---|---|---|---|
| 1,925,702 | A * | 9/1933 | Nelson | 165/299 |
| 3,303,576 | A * | 2/1967 | Sisson | 34/115 |
| 4,693,015 | A * | 9/1987 | Hemsath et al. | 34/454 |
| 6,560,893 | B1 * | 5/2003 | Bakalar | 34/110 |
| 6,953,516 | B2 * | 10/2005 | Hermans et al. | 162/198 |

* cited by examiner

*Primary Examiner* — Stephen M. Gravini
(74) *Attorney, Agent, or Firm* — Michael J. Sullivan

(57) ABSTRACT

A through-air dryer system that diverts the airflow within the through-air dryer during warm up and cool down from the normal airflow during the drying of paper in the papermaking process. During warm up and cool down, a majority of the airflow is supplied to one of the dryer's heads and extracted through the opposite head to reduce thermal stresses. If needed to further reduce thermal stresses, a minority of the airflow is supplied through the dryer's shell.

18 Claims, 4 Drawing Sheets

METHOD FOR WARMING UP OR COOLING DOWN A THROUGH-AIR DRYER

BACKGROUND

In the manufacture of tissue paper, often a through-air dryer is used to non-compressively dry the tissue paper to provide for a softer tissue paper. Since the tissue web is often molded by the through-air dryer fabric during the drying process, the design of the through-air dryer fabric has a large impact on the physical properties of the tissue paper. Often it is necessary to change the through-air dryer fabric to a different fabric when changing the grade of tissue paper being produced. Alternatively, the through-air dryer fabric needs to be changed when it becomes worn out or damaged.

In order to change the through-air dryer fabric, the stock feeding the paper machine must be diverted and the paper machine brought to a slower idling speed. The machine is then run at this slower speed until the through-air dryer and through-air dryer fabric cool sufficiently such that the paper machine can be brought to a stop without burning the fabric portion remaining within the through-air dryer. Once the through-air dryer is cool enough to work on, the fabric can be changed and the cycle reversed to bring the paper machine back on-line.

Because of the thermal mass involved, it takes a fairly long time to warm up or cool down the through-air dryer. Also, because of the design and materials used to make the through-air dryer, different parts of the dryer can take different lengths of time to warm up or cool down. The temperature differential and differences in the coefficient of thermal expansion between the different materials used in the construction of the through-air dryer can cause thermal stresses in the through-air dryer during warm up or cool down. To limit the induced thermal stresses, the warm up or cool down duration is often increased beyond the minimum time period it would take to warm up or cool down the through-air dryer if done as fast as possible. Increasing the warm up or cool down period represents a significant loss in productivity every time the through-air dryer fabric needs to be changed. Therefore, what is needed is a faster way to warm up and cool down a through-air dryer in order to speed up a fabric change while limiting the maximum thermal stresses to current or lower levels.

SUMMARY

The inventors have determined that the above needs can be met by a through-air dryer system that diverts the airflow within the through-air dryer during warm up and cool down from the normal airflow while drying the paper web in the papermaking process. By diverting the normal airflow, the warm up and cool down process can be sped up. In particular, the system directs more airflow towards the through-air dryer's journals and heads during warm-up and cool down since these portions of the through-air dryer have significantly more thermal mass and take much longer to change temperature. Less airflow is directed at the thin outer shell of the through-air dryer since this component has less thermal mass and a larger surface area and needs less airflow to warm up or cool down at the same rate as the heads. By diverting the airflow from the normal airflow during the drying operation, the entire through-air dryer can be warmed up or cooled down faster without causing an increase in the thermal stress between the dyer's shell and the dryer's heads.

Hence, in one aspect, the invention resides in a method of warming up or cooling down a through-air dryer roll having a shell and two opposing heads comprising feeding a majority of an airflow from a fan through one of the dryer roll's heads and extracting a majority of the airflow through the opposite head.

BRIEF DESCRIPTION OF THE DRAWINGS

The above aspects and other features, aspects, and advantages of the present invention will become better understood with regard to the following description, appended claims, and accompanying drawings where:

Figure 1:
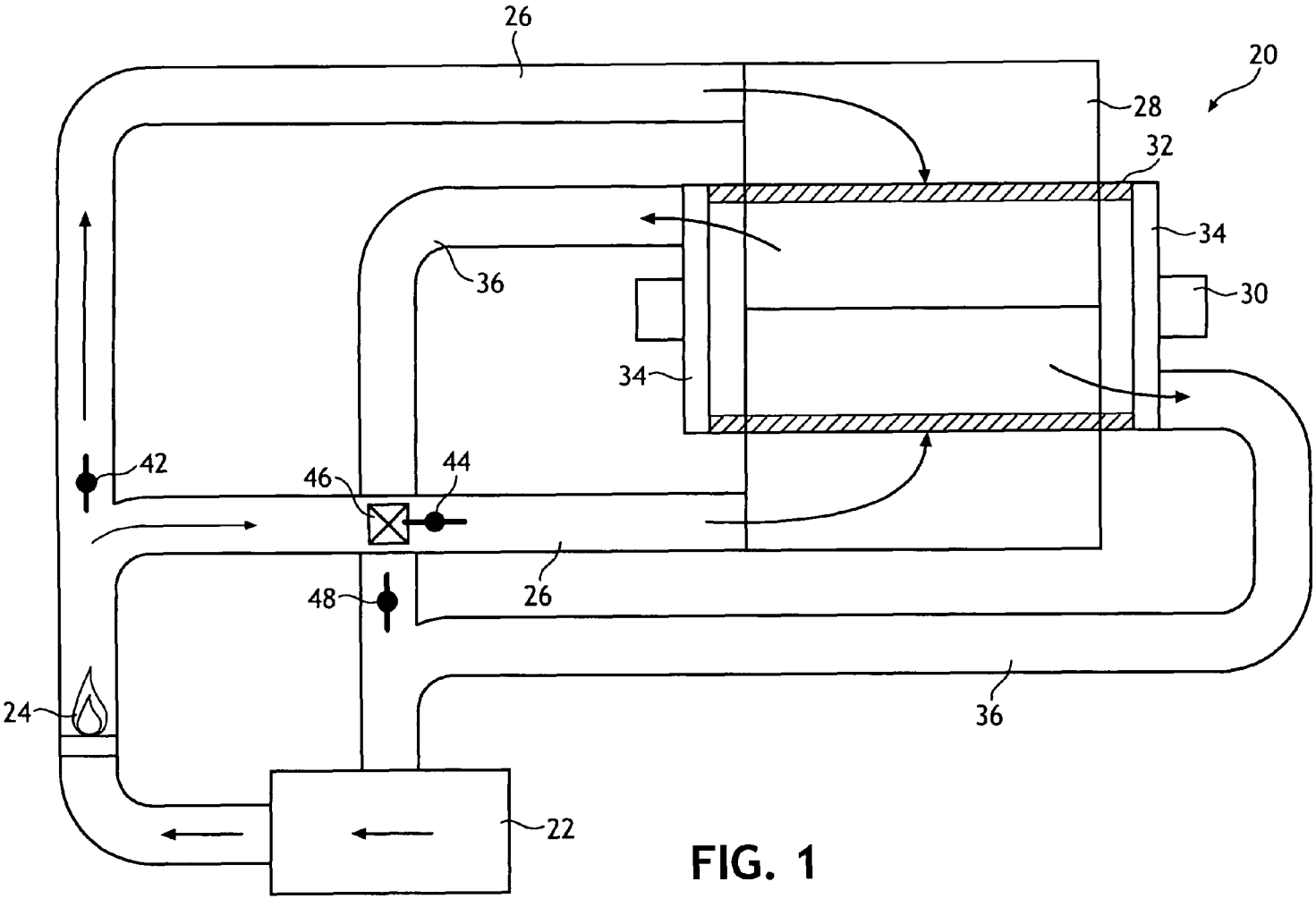
FIG. 1 illustrates a through-air dryer system in normal operation for drying the paper web.

Repeated use of reference characters in the specification and drawings is intended to represent the same or analogous features or elements of the invention.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

FIG. 1 illustrates one embodiment of a through-air dryer system 20. During normal operation while drying the paper web, a fan 22 directs air through a burner 24 to warm the air. The air is directed by dual inlet ducts 26 to feed both sides of a hood 28 surrounding a through-air dryer roll 30. The hot air then flows from the hoods through a paper web supported by a through-air dryer fabric wrapped about the dryer roll. The hot air passes from the paper web through the dryer fabric and then through a shell 32 or outer cylindrical surface of the dryer roll. After passing through the shell, the warm air passes out through both heads 34 of the dryer roll into dual outlet ducts 36 that redirect the cooler air back to the fan's inlet. Thus, in normal operation, all of the hot air enters the dryer roll 30 through the shell 32 and is extracted through both of the heads 34 in an approximately equal volume.

Figure 2:
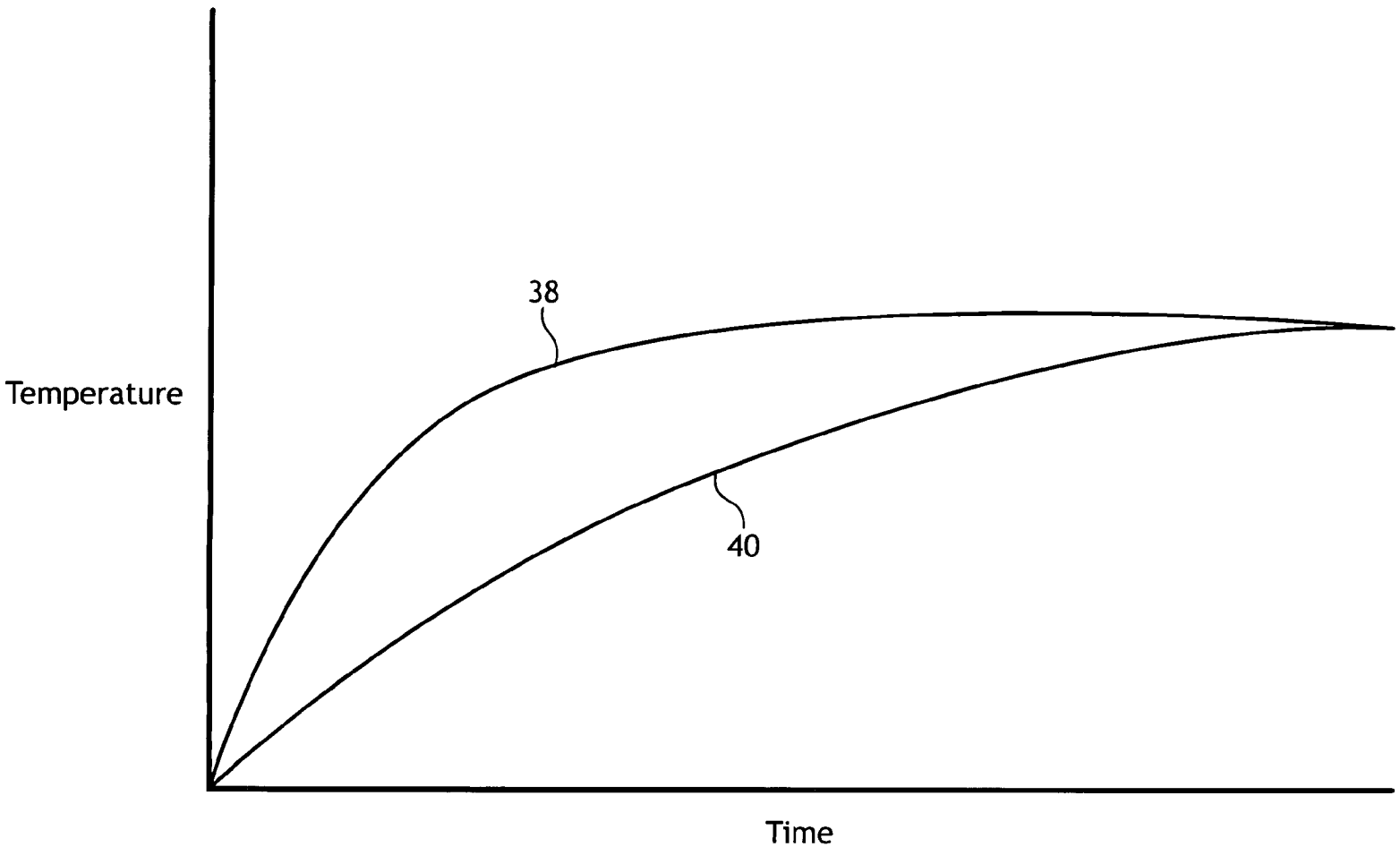
FIG. 2 illustrates theoretical warm up curves for the shell and the heads of a through-air dryer roll.

If the airflow in FIG. 1 is maintained during warm up or cool down, then the through-air dryer roll 30 can only be heated or cooled at a slower rate to prevent causing too much thermal stress between the heads 34 and the shell 32 by the relatively rapid temperature change of the shell 32 as compared to the heads 34. Referring to FIG. 2, a theoretical warm up curve 38 for the shell, and a theoretical warm up curve 40 for the journal/heads are shown. As seen, if the full output of the burner 24 and fan 22 was directed in the manner shown in FIG. 1, the shell would reach operating temperature much faster than the journals and heads. It can be seen that the maximum temperature difference occurs between the start of the warm up operation and when the warm up operation is completed. If the through-air dryer was warmed up as shown in FIG. 2, the shell would rapidly expand as it got hot but the journals and heads would not expand as much. As such, a large thermal stress could occur at the interface between the shell 32 and the heads 34 because the expansion of the shell would be constricted by the smaller diameter of the heads creating a moment about the corner between the shell and the heads. This thermal stress can lead to stress cracks or even failure of the through-air dryer roll 30. In order to prevent this, through-air dryers are warmed up at a much slower rate by gradually increasing the output of the burner and by adhering to a strict warm up rate.

Figure 3:
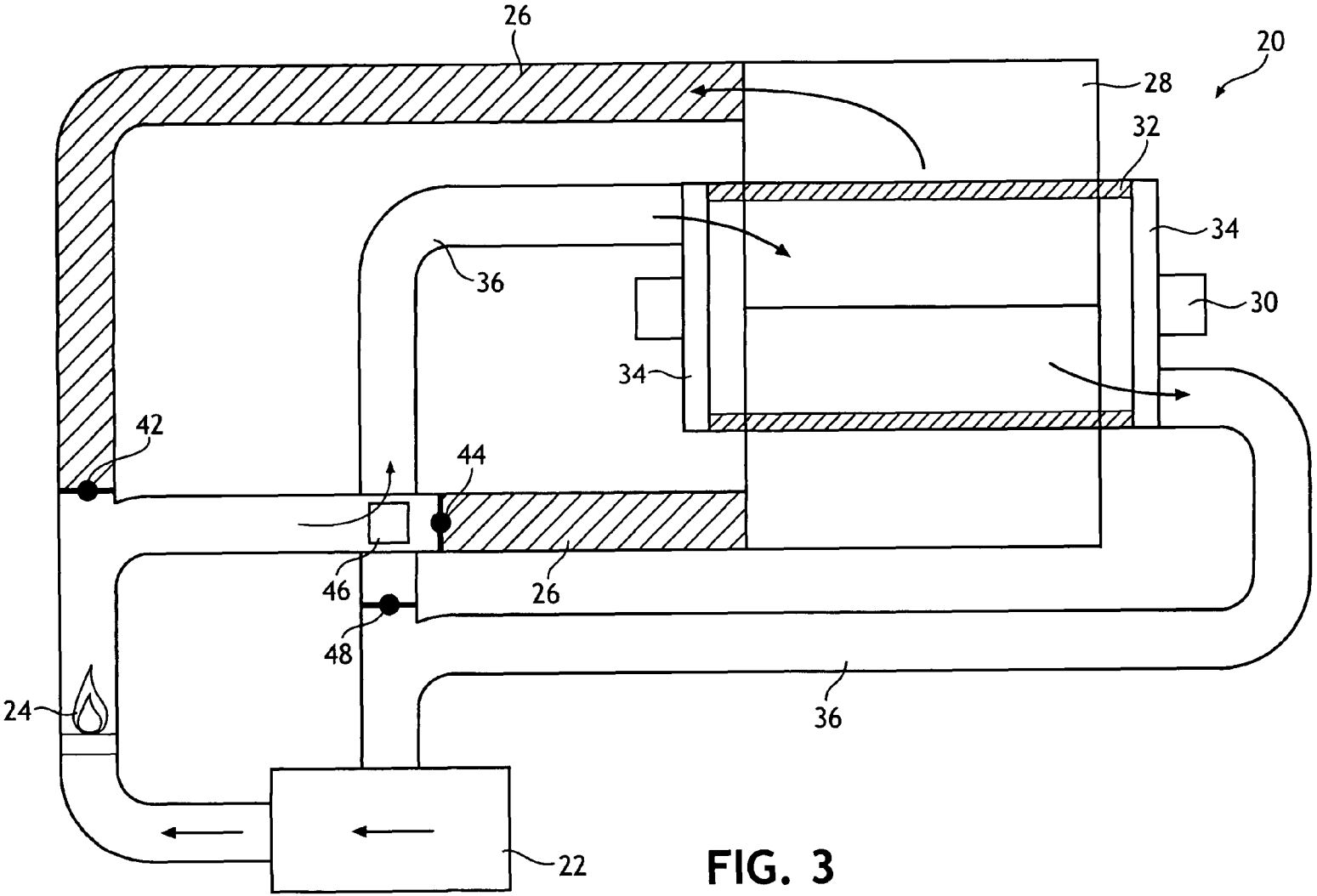
FIG. 3 illustrates the through-air dryer system of FIG. 1 in a warm up or cool down mode.

Referring now to FIG. 3, the through-air dryer system of FIG. 1 is shown in the warm up or cool down mode. As seen, three shut off dampers and a bypass damper redirect the airflow from its path during normal operation. In particular, a first 42 and a second 44 shut off damper are located in each of the inlet ducts 26 feeding the hood 28. These dampers are fully open during normal drying operation as seen in FIG. 1, but are closed or only partially open during warm up or cool down operation. As such, reduced airflow is present in the inlet ducts 26 as shown by the hatched lines during warm up or cool down. The inlet ducts 26 to the hood 28 can have minimal or even no airflow during warm up or cool down. Instead, a bypass damper 46 allows the airflow from the fan to flow into one of the outlet ducts 36 feeding the head 34 on one side of the dryer roll 30. A third shut off damper 48 located in the outlet duct 36 near the fan ensures that the airflow from the fan 22 feeds only one of the dryer's heads 34 through one of the outlet ducts 36 (now functioning as an inlet duct) and is extracted through the opposite head by the other outlet duct.

Thus, during warm up and cool down operation, the majority of the airflow enters one of the dryer's heads and is extracted through the dryer's opposite head. If necessary, to reduce the thermal stresses involved, a minority of the airflow from the fan can enter the dryer roll through the dryer's shell, as controlled by the first and second shut off dampers, and be extracted through one of the dryer's heads. In various embodiments of the invention during warm up and cool down of the through-air dryer roll, about 55 percent or greater of the airflow from the fan can enter one of the dryer's heads and be extracted through the opposite head, and about 45 percent or less of the airflow from the fan can enter the dryer roll through the dryer's shell and be extracted through one of the dryer's heads; or about 70 percent or greater of the airflow from the fan can enter one of the dryer's heads and be extracted through the opposite head, and about 30 percent or less of the airflow from the fan can enter the dryer roll through the dryer's shell and be extracted through one of the dryer's heads; or about 90 percent or greater of the airflow from the fan can enter one of the dryer's heads and be extracted through the opposite head, and about 10 percent or less of the airflow from the fan can enter the dryer roll through the dryer's shell and be extracted through one of the dryer's heads.

In this manner, since the majority of the airflow is directed at or through the heads 34 of the through-air dryer roll 30, the burner 24 can be controlled to a higher rate of temperature increase with less concern of heating up the shell 32 too quickly causing too large of a thermal stress. As such, the warm up or cool down time period can be significantly shortened and is now limited by the allowable warm up rate of the heads 34 to prevent high thermal stresses within the thickness of the head material. If desired to take advantage of the faster warm up or cool down rate, the heads can be redesigned to allow for a faster rate of temperature change. The airflow feeding the shell 32 can be greatly reduced or shut off by the first and second shut off dampers (42, 44) to prevent overheating of the shell 32 relative to the heads 34 during warm up or cool down.

If desired, the shut off dampers (42, 44, 48), the by pass damper (46), the burner's (24) output, and the fan (22) speed can be controlled by a closed loop control system. Appropriate temperature sensors can be installed and located to measure the temperature of the shell 32 and the heads 34. Any differences between the shell's temperature and the temperature of the heads can be determined and kept within a fixed differential by the control system. For example, if the heads 34 are hotter than the shell 32, the control system can adjust the first and second shut off dampers (42, 44) to provide more airflow to the shell. Similarly, if the shell 32 is getting too hot, the control system can close the first or second shut off dampers (42, 44) to reduce heating of the shell. Should the shut off dampers already be fully closed, the system can reduce the burner's output to more slowly bring the entire through-air dryer up to temperature. Suitable temperature monitoring devices can directly read the temperature using either contacting or non-contacting infrared methods or by monitoring the inlet and exhaust temperature of the air to determine the appropriate control of the air through the heads 34 and the shell 32. For example, temperature sensors can be located close to the heads 34 or the shell 32 in the airflow after passing through these structures used to monitor the temperature of the airflow near or adjacent to these structures. These temperatures can be used to provide an estimate of the actual temperatures of the heads 34 or the shell 32. Multiple temperature sensors can be used, as needed, to measure the temperature at various positions of the heads 34 or shell 32.

Figure 4:
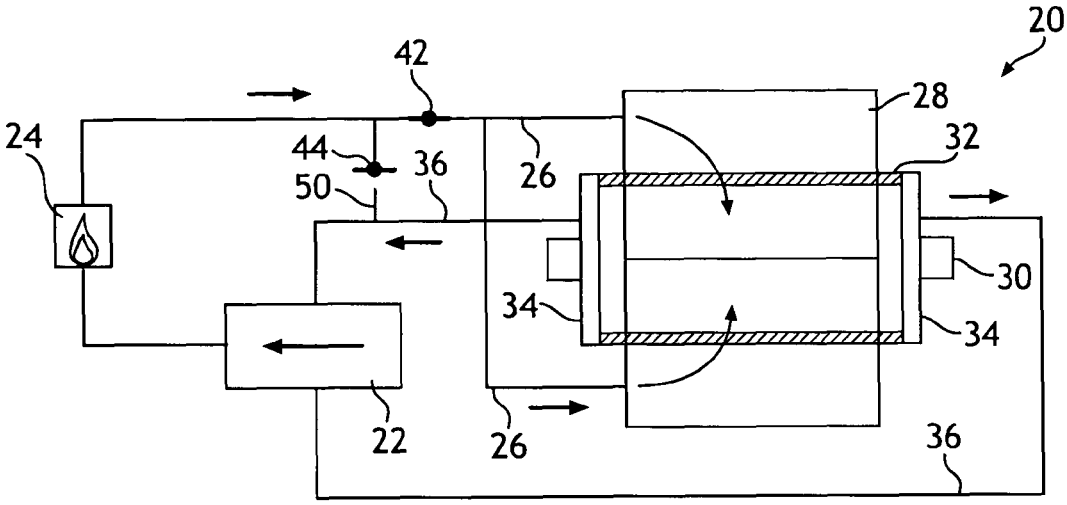
FIG. 4 illustrates another through-air dryer system in normal operation.
Figure 5:
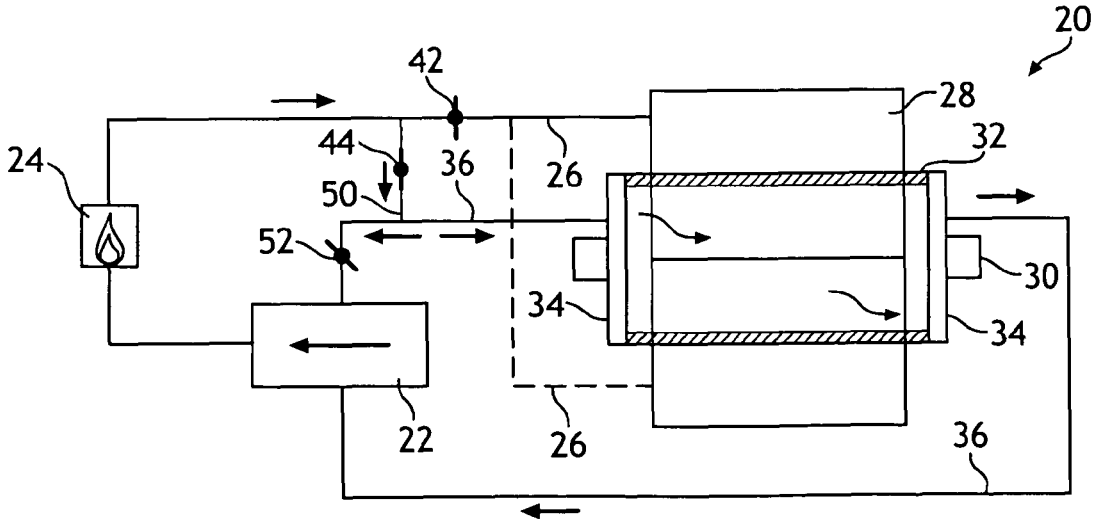
FIG. 5 illustrates the through-air dryer system of FIG. 4 is a warm up or cool down mode.

Referring now to FIGS. 4 and 5, an alternative embodiment of the through-air dryer system 20 is shown. In particular, the system uses a dual inlet fan 22 to feed two inlet ducts 26 to the hood 28 and to extract air from two outlet ducts 36 connected to each of the dryer's heads 34. Thus, in normal operation, all of the hot air enters the through-air dryer roll 30 through the shell 32 and is extracted through both of the heads 34 in an approximately equal volume. This in turn provides approximately equal volumes of air to both of the fan's inlets helping to reduce thrust forces within the fan.

During warm up and cool down operations, a first shut off damper 42 closes or reduces the airflow to the inlet ducts 26 feeding the hood 28. A second shut off damper 44 opens a bypass duct 50 that redirects the airflow from the fan 22 to one of the dryer roll's heads 34 through an outlet duct 36 now acting as an inlet duct. In order to balance the airflow delivered to the dryer roll 30 and to one of the fan's inlets, a variable bypass damper 52 is located in the return loop to one of the fan's inlet ducts. The damper is used to balance the airflow between both inlets to the fan in the warm up and cool down mode. If desired, a control system monitoring the temperatures of the shell 32 and the heads 34 can be used as previously described to keep the temperature differential within a limited range. As described in conjunction with the system of FIG. 1, the same percentage of airflows directed through the heads and/or through the shell can also be used.

While use of the warm up and cool down method has been primarily described with through-air dryers that feed the shell and extract through the heads in normal drying operation, the principles involved can be applied to through-air dryers that feed the heads and extract through the shell in normal drying operation. A control system with temperature sensors to measure the temperature of the heads and the shell or the temperature of the airflow after passing over these structures can be used to automate the process to limit the maximum temperature differential allowed as previously described.

In particular, such a system in a warm up or cool down mode can be configured by the use of appropriate dampers to feed only one of the heads with airflow from the fan and then extract the majority of that air through the opposite head rather than through the shell during warm up. If necessary, to reduce the thermal stresses involved, a minority of the airflow from the fan can enter the dryer roll through one of the dryer's heads and be extracted through the dryer's shell. Thus, in various embodiments of the invention, about 55 percent or greater of the airflow from the fan can enter one of the dryer roll's heads and be extracted through the opposite head, and about 45 percent or less of the airflow from the fan can enter the dryer roll through one of the dryer roll's heads and be extracted through the shell by the hood; or about 70 percent or greater of the airflow from the fan can enter one of the dryer roll's heads and be extracted through the opposite head, and about 30 percent or less of the airflow from the fan can enter the dryer roll through one of the dryer roll's heads and be extracted through the shell by the hood; or about 90 percent or greater of the airflow from the fan can enter one of the dryer roll's heads and be extracted through the opposite head, and about 10 percent or less of the airflow from the fan can enter the dryer roll through one of the dryer roll's heads and be extracted through the shell by the hood.

It can also be seen that through-air drying systems that have airflow during normal operation from the heads through the shell can also benefit from this invention by directing the airflow through the opposing head during the warm up/cool down cycle to prevent excessive stresses in the head to shell joint and decreasing the time for warm up/cool down.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A method comprising:

warming up or cooling down a through-air dryer roll having a shell with an outer cylindrical surface through which hot air passes and two opposing heads further comprising the method steps of:

feeding a majority of an airflow from a fan through one of the through-air dryer roll's heads and extracting a majority of the airflow through the opposite head;

reversing the airflow after warming up or cooling down the through-air dryer roll such that in normal operation the majority of the airflow from the fan and a burner is supplied to a through-air dryer hood partially surrounding the through-air dryer roll;

moving the hot air through the through-air dryer rows shell; and extracting the hot air through the through-air dryer roll's heads.

2. The method of claim 1 comprising feeding a minority of the airflow from the fan to a through-air drier hood partially surrounding through-air dryer roll and then through the through-air dryer roll's shell, and extracting the minority of the airflow through one of the through-air dryer roll's heads.

3. The method of claim 2 wherein about 55 percent or greater of the airflow from the fan enters one of the through-air dryer roll's heads and is extracted through the opposite head, and about 45 percent or less of the airflow from the fan enters the through-air dryer roll through the shell and is extracted through one of the through-air dryer's heads.

4. The method of claim 2 wherein about 70 percent or greater of the airflow from the fan enters one of the through-air dryer roll's heads and is extracted through the opposite head, and about 30 percent or less of the airflow from the fan enters the through-air dryer roll through the shell and is extracted through one of the through-air dryer's heads.

5. The method of claim 2 wherein about 90 percent or greater of the airflow from the fan enters one of the through-air dryer roll's heads and is extracted through the opposite head, and about 10 percent or less of the airflow from the fan enters the through-air dryer roll through the shell and is extracted through one of the through-air dryer's heads.

6. The method of claim 1 comprising feeding a minority of the airflow from the fan through the through-air dryer roll's shell and extracting it through a through-air dryer hood partially surrounding the through-air dryer roll.

7. The method of claim 6 wherein about 55 percent or greater of the airflow from the fan enters one of the through-air dryer roll's heads and is extracted through the opposite head, and about 45 percent or less of the airflow from the fan enters the through-air dryer roll through one of the through-air dryer roll's heads and is extracted through the shell by the through-air dryer hood.

8. The method of claim 6 wherein about 70 percent or greater of the airflow from the fan enters one of the through-air dryer roll's heads and is extracted through the opposite head, and about 30 percent or less of the airflow from the fan enters the through-air dryer roll through one of the through-air dryer roll's heads and is extracted through the shell by the through-air dryer hood.

9. The method of claim 6 wherein about 90 percent or greater of the airflow from the fan enters one of the through-air dryer roll's heads and is extracted through the opposite head, and about 10 percent or less of the airflow from the fan enters the through-air dryer roll through one of the through-air dryer roll's heads and is extracted through the shell by the through-air dryer hood.

10. The method of claim 1 comprising:

altering the airflow after warming up or cooling down the through-air dryer roll such that in normal operation the majority of the airflow from the fan and a burner is supplied to the through-air dryer roll's heads;

moving the hot air through the through-air dryer roll's shell; and extracting the hot air through a through-air dryer hood partially surrounding the through-air dryer roll.

11. The method of claim 2 comprising monitoring the temperature of the shell and the temperature of the heads; determining a temperature differential between the shell and the heads; providing an automatic control system, adjusting the airflow supplied to the heads and adjusting the airflow through the shell to maintain the temperature differential less than a predetermined maximum amount.

12. The method of claim 6 comprising monitoring the temperature of the shell and the temperature of the heads; determining a temperature differential between the shell and the heads; providing an automatic control system, adjusting the airflow supplied to the heads and adjusting the airflow through the shell to maintain the temperature differential less than a predetermined maximum amount.

13. A system comprising:

a through-air dryer roll having a shell with an outer cylindrical surface through which hot air passes and a pair of opposing heads, the through-air dryer roll at least partially enclosed by a through-air dryer hood;

a fan with its outlet connected to a burner which is ducted to a pair of inlet ducts connected to the through-air dryer hood;

a pair of outlet ducts each having one end attached to one of the through-air dryer roll's heads and the opposing end ducted to the inlet of the fan;

a first and a second shut off damper located in each of the inlet ducts to the through-air dryer hood;

a bypass damper connecting one of the inlet ducts to the outlet ducts; and a third shut off damper located in on one of the outlet ducts between the bypass damper and the fan's inlet.

14. The system of claim 13 wherein the bypass damper is open, the first and second shut off dampers are closed or partially open, and the third shut off damper is closed thereby feeding a majority of an airflow from the fan through one of the through-air dryer roll's heads and extracting a majority of the airflow through the opposite head.

15. The system of claim 14 comprising feeding a minority of the airflow from the fan to the through-air dryer hood partially surrounding the through-air dryer roll and then through the through-air dryer roll's shell, and extracting the minority of the airflow through one of the through-air dryer roll's heads.

16. A system comprising:

a through-air dryer roll having a shell with a outer cylindrical surface though which hot air passes and a pair of opposing heads, the through-air dryer roll at least partially enclosed by a through-air dryer hood;

a dual inlet fan with its outlet connected to a burner which is ducted to a pair of inlet ducts connected to the through-air dryer hood;

a pair of outlet ducts each having one end attached to one of the through-air dryer roll's heads and the opposing end ducted to one of the fan's inlets;

a first shut off damper located between the inlet ducts and the burner for closing or reducing the airflow to the inlet ducts feeding the through-air dryer hood;

a second shut off damper located in a bypass duct connecting the outlet of the burner prior to the first shut off damper to one of the fan's inlet; and a variable by pass damper located in one of the fan's inlet ducts for balancing the airflow between both inlet ducts.

17. The system of claim 16 wherein the first shut off damper is closed or partially closed and the second shut off damper in the bypass duct is open thereby feeding a majority of an airflow from the fan through one of the through-air dryer roll's heads and extracting a majority of the airflow through the opposite head.

18. The system of claim 17 comprising feeding a minority of the airflow from the fan to the through-air dryer hood partially surrounding the through-air dryer roll and then through the through-air dryer roll's shell, and extracting the minority of the airflow through one of the through-air dryer roll's heads.

* * * * *